US008717378B2

(12) United States Patent
Botzas

(10) Patent No.: US 8,717,378 B2
(45) Date of Patent: May 6, 2014

(54) METHOD AND APPARATUS FOR REDUCED GATE COUNT GAMMA CORRECTION

(75) Inventor: Anthony Botzas, San Jose, CA (US)

(73) Assignee: Samsung Display Co., Ltd. (KR)

( * ) Notice: Subject to any disclaimer, the term of this patent is extended or adjusted under 35 U.S.C. 154(b) by 647 days.

(21) Appl. No.: 13/074,978

(22) Filed: Mar. 29, 2011

(65) Prior Publication Data

US 2012/0249574 A1 Oct. 4, 2012

(51) Int. Cl.
*G09G 1/00* (2006.01)

(52) U.S. Cl.
USPC ..... 345/589; 345/596; 345/613; 345/690

(58) Field of Classification Search
None
See application file for complete search history.

(56) References Cited

U.S. PATENT DOCUMENTS

| | | | | |
|---|---|---|---|---|
| 6,064,396 | A * | 5/2000 | Ouchi et al. | 345/604 |
| 2005/0276502 | A1* | 12/2005 | Brown Elliott et al. | 382/254 |
| 2008/0030526 | A1* | 2/2008 | Brown Elliott et al. | 345/694 |
| 2009/0051818 | A1* | 2/2009 | Furukawa et al. | 348/674 |
| 2009/0195547 | A1* | 8/2009 | Abe | 345/501 |
| 2009/0284546 | A1* | 11/2009 | Brown Elliott | 345/596 |
| 2011/0148942 | A1* | 6/2011 | Furihata et al. | 345/690 |

* cited by examiner

*Primary Examiner* — Ulka Chauhan
*Assistant Examiner* — Sultana M Zalalee
(74) *Attorney, Agent, or Firm* — Innovation Counsel LLP

(57) ABSTRACT

A cubic, or other polynomial, approximation to a panel's gamma function. Embodiments contemplate a display system configured to apply a panel gamma function that is a third-order polynomial function, as well as its substantial inverse. This third order function is often easier to implement, and yields lower gate count than current power law gamma functions.

23 Claims, 5 Drawing Sheets

METHOD AND APPARATUS FOR REDUCED GATE COUNT GAMMA CORRECTION

BRIEF DESCRIPTION

This invention relates generally to flat panel displays. More specifically, this invention relates to reduced gate count gamma correction.

BACKGROUND

In digital image processing, an image is typically represented as a number of pixels. Each pixel's color is defined by the color's coordinates in some color space, e.g. sRGB. The display converts the color coordinates to "grey levels" which are then used to define electrical signals (e.g. voltages) that determine luminous states of corresponding areas on the screen of the display. Sometimes, the color coordinates themselves can be used as grey levels. Prior to display, these grey levels are usually adjusted by some function (usually called a "gamma function", "gamma transfer function", "gamma transfer characteristic", or "gamma curve").

For many displays, the gamma function is non-linear, and can be approximated by a power relationship:

$$L=x^{\gamma} \tag{1}$$

where L is the normalized luminance, x is the grey level, and γ is a constant for the display. In many CRTs (Cathode Ray Tubes), LCDs (Liquid Crystal Displays), and some other types of devices, γ is about 2.2. However, the relationship (1) and/or γ value are approximate, and can vary. Such variation can be adjusted or corrected for by, for example, using look-up tables (LUTs) tabulating values for a specific relationship that may differ somewhat from (1).

Therefore, with reference to FIG. 1, conventional systems often apply a single gamma function such as (1) to input image data (e.g., sRGB data received from a transmission) as part of some current widely-used image display standards, e.g. to correctly display sRGB images. More specifically, as shown in FIG. 1, conventional systems employ a single Panel Gamma block that receives digital input image data (typically, 8-bit digital image data intended for display, such as output from a graphics card), applies gamma function (1) to the image data and converts it to analog, and outputs the gamma-corrected, analog luminance values that drive a display.

A typical color display is associated with a set of primary colors, e.g. red, green and blue. The display accepts separate grey levels for each of the primary colors (i.e. for each "channel"). The gamma functions can be different for different channels, and therefore separate LUTs can be provided for each channel.

For example, a color LCD may include a number of red, green and blue subpixels. The subpixels have identical liquid crystal cells, but have color filters of different colors (red, green, blue). The liquid crystal cells however have different optical activity with respect to wavelength and hence to color. Depending on the spectral bandwidth of the color filters, such optical activity can result in unequal luminance gamma transfer characteristics amongst the R, G, B channels. In addition, the optical activity can result in chrominance deviations (e.g. hue deviations) within each channel. The unequal gamma transfer characteristics can be corrected using the separate LUTs for each channel.

SUMMARY

The invention can be implemented in a number of ways, including as an apparatus, a method, and as a computer-readable medium.

In one embodiment, a display system comprises a gamma preconditioning circuit configured to receive image data, to apply a first gamma function to the image data so as to generate gamma-compensated image data, and to output the gamma-compensated image data. The display system also includes a processing circuit in electronic communication with the gamma preconditioning circuit, the processing circuit configured to receive the gamma-compensated image data, to perform an image processing operation on the gamma-compensated image data so as to generate processed image data, and to output the processed image data. Also included is an output gamma circuit in electronic communication with the processing circuit, the output gamma circuit configured to receive the processed image data, to apply a second gamma function to the processed image data so as to generate gamma-encoded processed image data, and to output the gamma-encoded processed image data, wherein the second gamma function comprises a third order polynomial function.

In another embodiment, a method of gamma-correcting image data comprises applying a first gamma function to image data, so as to generate first compensated image data, as well as applying a second gamma function to the first compensated image data, so as to generate second compensated image data. The second gamma function comprises a third order polynomial function. The method also includes applying a third gamma function to the second compensated image data so as to generate third compensated image data, wherein the third gamma function is substantially an inverse of the third order polynomial function.

In a further embodiment, a non-transitory computer-readable medium comprises one or more non-transitory computer-readable mediums collectively storing instructions for carrying out a method. The method comprises applying a first gamma function to image data, so as to generate first compensated image data, and applying a second gamma function to the first compensated image data, so as to generate second compensated image data. The second gamma function comprises a third order polynomial function. The method also includes applying a third gamma function to the second compensated image data so as to generate third compensated image data, wherein the third gamma function is substantially an inverse of the third order polynomial function.

Other aspects and advantages of the invention will become apparent from the following detailed description taken in conjunction with the accompanying drawings which illustrate, by way of example, the principles of the invention.

BRIEF DESCRIPTION OF THE DRAWINGS

For a better understanding of the invention, reference should be made to the following detailed description taken in conjunction with the accompanying drawings, in which.

Like reference numerals refer to corresponding parts throughout the drawings.

DETAILED DESCRIPTION

Figure 1:
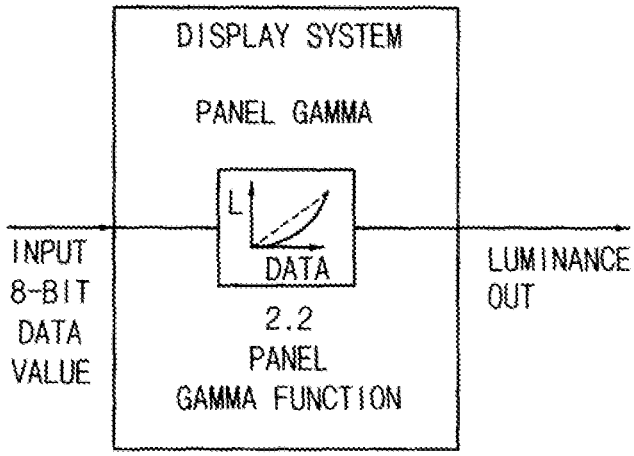
FIG. 1 (PRIOR ART)
FIG. 1 is a block diagram representation of a conventional display system that applies a single power-law gamma function to its input data.

As above, conventional systems employ a single Panel Gamma block that is implemented as an analog circuit, and that applies a power law gamma function such as equation (1) to image data, largely to comply with current standards such as the sRGB standard. However, this approach presents difficulties if one wishes to apply digital image processing to gamma-corrected data, as the output of the panel gamma block of FIG. 1 is analog, rather than digital.

Figure 2:
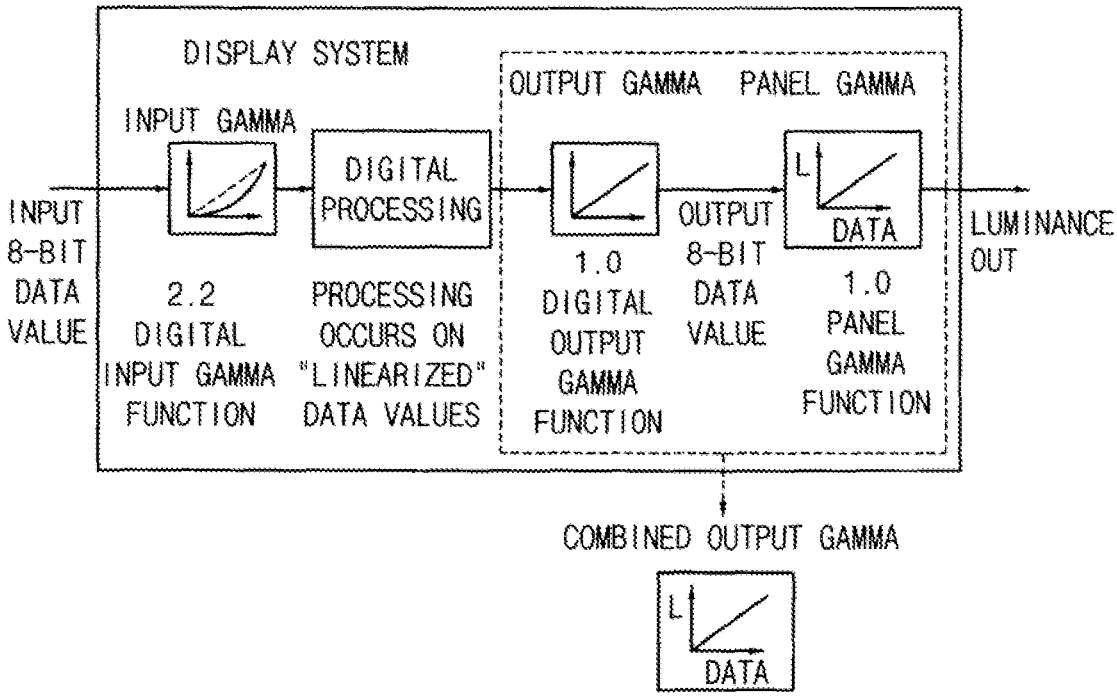
FIG. 2 illustrates an exemplary display system employing a digital input gamma function and linear output and panel gamma functions.

To apply digital image processing methods to image data, a display's gamma block should output digital gamma-corrected image data, rather than analog signals. The output of the gamma block is then suitable for digital image processing. This approach is illustrated in FIG. 2. Here, an Input Gamma block gamma corrects input image data much like the Panel Gamma block of FIG. 1, except that the output of the Input Gamma block is digital, not analog, data. As much digital image processing is performed at higher than 8-bit bit depths, the Input Gamma block can also increase the bit depth of the data, e.g. from 8-bit to 11-bit data. Desired digital image processing is then performed in the Digital Processing block. As the data is already gamma-corrected, the output data can simply be converted back to the appropriate bit depth (here, 8 bits), and converted to analog signals for driving the display. This is shown here as an Output Gamma block that converts data from the higher bit depth used by the Digital Processing Block back down to 8-bit data, and a Panel Gamma block that converts this 8-bit digital data to analog output for display. As neither the Output Gamma nor the Panel Gamma block needs to apply a gamma function, each is shown as simply mapping input luminance to output luminance uniformly, i.e. applying linear function $y=x$, where x is the input luminance and y is the output luminance of each block.

One would think that the approach of FIG. 2 would be sufficient. However, this approach suffers from disadvantages. For example, the relatively flat initial slope of the curve of equation (1) compresses many smaller input luminance values into a range of very small output luminance values. When converted back to 8-bit depth, many of these small luminance values are truncated to zero, compromising the accuracy of the resulting image and creating undesirable artifacts such as dark shadows and dark gradients that are rendered entirely black.

Figure 3:
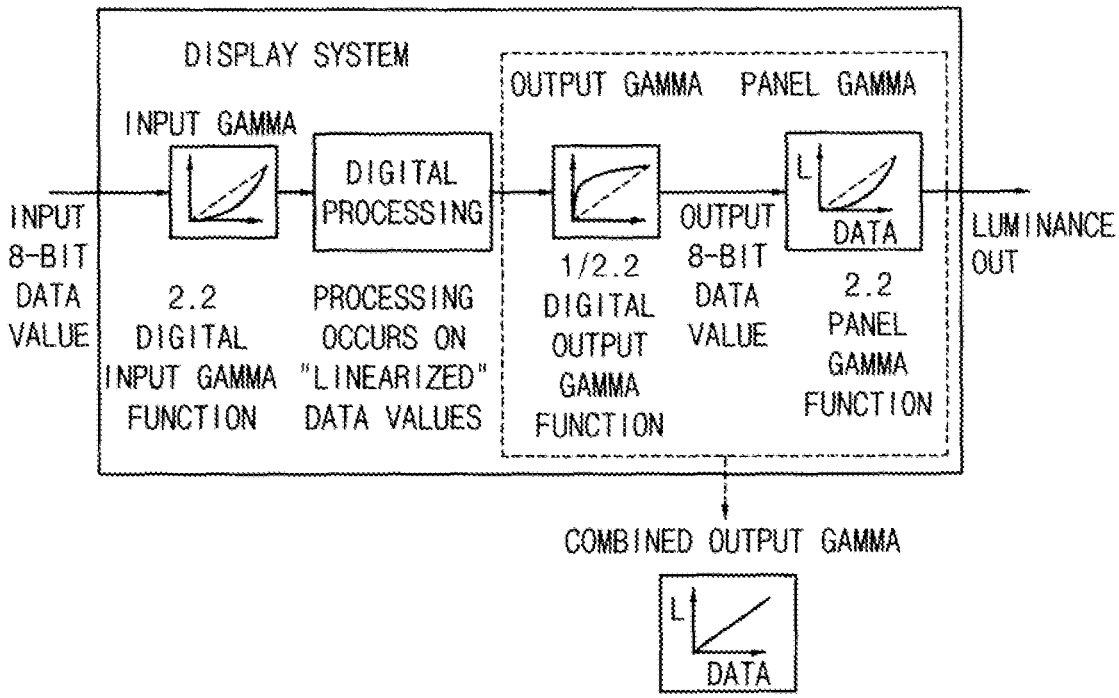
FIG. 3 illustrates a further exemplary display system employing a digital input gamma function and power law output and panel gamma functions.

To avoid these undesirable effects, one may think to instead implement a system such as that shown in FIG. 3, with the Output Gamma and Panel Gamma blocks implementing a $\gamma=1/2.2$ and $\gamma=2.2$ function, respectively. That is, the Output Gamma block of FIG. 3 both reduces the bit depth of the image data to 8 bits, and applies a $\gamma=1/2.2$ function, as shown. The Panel Gamma block of FIG. 3 is thus a conventional Panel Gamma block such as that of FIG. 1, which applies a $\gamma=2.2$ function and converts the digital data to analog signals. This system does not have the truncation problems of FIG. 2, as the high initial slope of the $\gamma=1/2.2$ function effectively re-expands the low input luminance values that were compressed by the initial slope of the Input Gamma block. That is, low luminance values are amplified and spread out by the high initial slope of the $\gamma=1/2.2$ function, increasing their luminance values and making them more likely to avoid truncation. Once converted back to 8-bit data, the Panel Gamma block applies the inverse $\gamma=2.2$ function to effectively cancel the gamma function of the Output Gamma block, with the net effect being that only the gamma function of the Input Gamma block is applied.

However, the configuration of FIG. 3 also suffers from drawbacks. In particular, the $\gamma=1/2.2$ function is difficult to implement with low gate count. Thus, the Output Gamma block of FIG. 3 often requires excessively high gate count to implement.

Embodiments of the invention solve this problem by implementing a polynomial approximation to the $\gamma=1/2.2$ function, rather than implementing a power law. In one embodiment, the invention employs a cubic approximation to a panel's gamma function. This results in a significant savings in gate count, and thus an improvement in the size, complexity, power consumption, and expense of image processing hardware.

Figure 4:
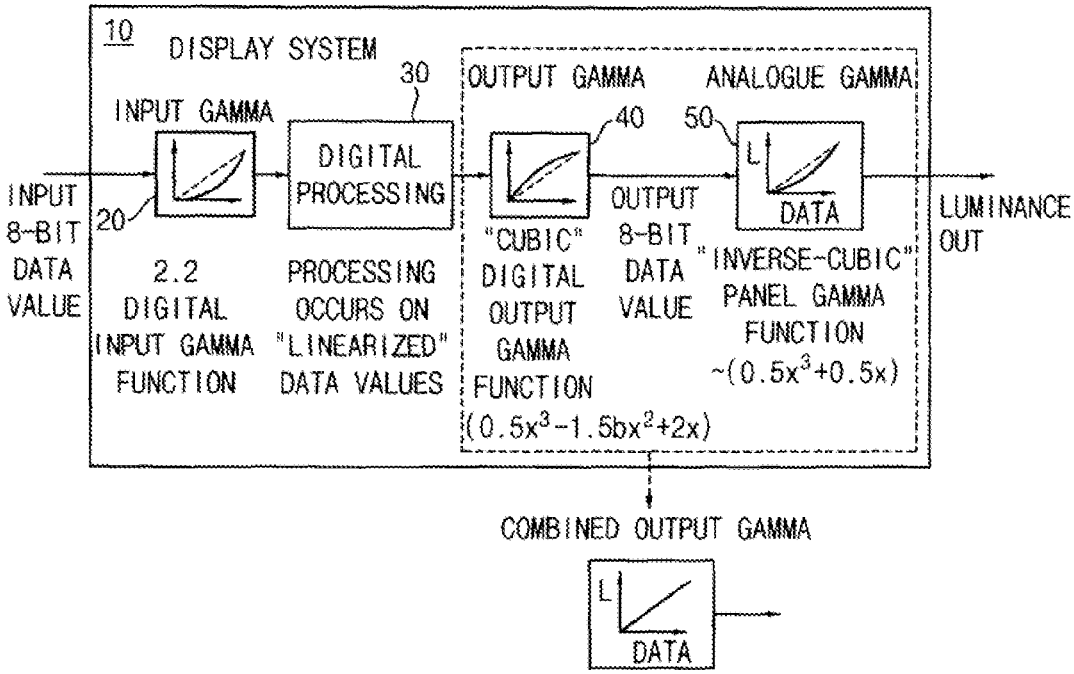
FIG. 4 illustrates an exemplary display system implementing a digital input gamma function and reduced-gate-count cubic output and panel gamma functions.

FIG. 4 is a block diagram illustration of an exemplary display system implementing a third order polynomial output gamma function according to an embodiment of the invention. Here, display system 10 can be any image display system, but is commonly implemented as a flat panel display (e.g., LED, OLED, etc.) system. The display system 10 includes an input gamma block 20 applying an input gamma function to input image data, a digital processing block 30 performing various processing operations on the image data, an output gamma block 40 applying an output gamma function to cancel the panel's gamma function, and a panel gamma block 50 implementing the panel's gamma function, which is substantially the inverse of the output gamma function from block 40.

The input gamma block 20 applies a "standard" gamma function to the input image data, i.e. a power law function such as equation (1), typically to comply with established standards such as the sRGB standard. The digital processing block 30 processes the gamma-corrected image data to improve image quality. Any such processing operations are contemplated. For example, the processing block 30 can perform any one or more of sub-pixel rendering, filtering, contrast and color enhancement, and the like. Output gamma block 40 then applies a third order polynomial gamma function to the image data, whereupon the image data is converted to 8-bit format and the panel gamma block 50 applies the panel gamma function, which is substantially the inverse of the gamma function applied by output gamma block 40. Thus, the gamma functions of the blocks 40, 50 effectively cancel each other, with the net effect being that the only gamma function applied to the output image is that from input gamma block 20. As is known, the above described blocks 20-50 can be implemented as circuits that perform the respective tasks described herein.

In operation, a stream of image data is input to display system 10 and sent to the input gamma block 20. Typically, this image data is in an 8-bit format, as is common in sRGB images and other images conforming to many current display standards. The input gamma block 20 applies a first gamma function to the 8-bit image data, and also upconverts (i.e. increases the bit depth of) the data to an 11-bit format via known methods. Thus, the output of block 20 is commonly 11-bit image data that has been gamma decoded by a $\gamma=2.2$ or similar gamma function. The input gamma block 20 sends this upconverted, gamma-decoded data to digital processing block 30, which performs its operations on the 11-bit data. The digital processing block 30 then sends its output to output gamma block 40, which applies a second gamma function to the output of digital processing block 30, and also downconverts (decreases the bit depth of) this data back to the bit depth of the input image data. In the sRGB example, the output gamma block 40 converts the 11-bit output of the digital processing block 30 back to 8-bit data for output to the panel gamma block 40. The panel gamma block 50 then applies a third gamma function to the 8-bit image data, where this third gamma function is largely the inverse of the second gamma function. As shown by the "Combined Output Gamma" box of FIG. 4, the third gamma function "cancels" the second gamma function, with the net effect being that the output luminance of the display system 30 is linear with respect to the input data, so that effectively the only gamma correction applied to the image data is the first gamma function from input gamma block 20.

It should be noted that, while some blocks of display system 10 convert images from one bit depth to another, the invention is not limited to any particular bit depths, and the bit depth conversions can take place in any suitable blocks, whether shown in FIG. 4 or not. For example, while it may be desirable for digital processing block 30 to operate on image data having a bit depth of 11 bits, block 30 may also operate on image data of any other bit depth, with input gamma block 20 converting the image data accordingly. It should also be noted that bit depth conversions may be simple conversions of one bit depth to another, or may include data for other image processing operations. For instance, the output gamma block 40 may perform straightforward conversions of 11-bit data to 8-bit data, or may convert the 11-bit output of digital processing block 11 to 8-bit data, along with 2 dither bits for performing dithering operations on the 1-bit output image data. Any other form and manner of bit depth conversions are also contemplated.

In display system 10, input gamma block 20 implements a gamma function that is a "standard" gamma function, i.e. a known gamma function that is typically applied in conventional display systems. This gamma function is typically a power-law function which, as above, often requires significant gate count to implement. In contrast, the output gamma block 40 and panel gamma block 50 respectively apply a reduced gate count gamma function and its inverse. In one embodiment, the gamma function implemented by output gamma block 40 is a third order polynomial function, i.e. a cubic polynomial function of the form:

$$y=Ax^3+Bx^2+Cx \tag{2}$$

Where y is the digital output value of the output gamma function, and A, B, and C are coefficients that can take on any suitable value. The coefficients A, B, C can be chosen in any manner. For example, they can be chosen so as to provide a best fit to a gamma function specified by a desired standard, or may be chosen simply to provide a desired display output. The coefficients can also be chosen by specifying desired boundary conditions that a gamma function should meet. For example, it may be desirable to specify that the output gamma curve be zero and have a starting slope start_s1 at its origin, and have an ending slope end_s1 at its normalized end point (x2, y2) (where the end point is normalized to 1). Equations for A, B, and C thus become:

$$A=(\text{start_}s1+\text{end_}s1)/x2^2-2(y2/x2^3)$$

$$B=3(y2/x2^2)-(2\text{start_}s1+\text{end_}s1)/x2$$

$$C=\text{start_}s1 \tag{3}$$

Here, the normalized end point can be chosen as (1, 0.5) rather than (1, 1), in order to produce a gamma function that both shifts state-densities and reduces bit depth by one bit. This is desirable in cases where, for example, the output gamma block 40 has 11-bit data input and 10-bit data out. For this normalized end point, and for start_s1=1 and end_s1=0.25, solving equations (3) results in a gamma function $\gamma=0.25x^3-0.75x^2+x$. Alternatively, for a normalized end point of (1, 1), the coefficients double, resulting in a gamma function $\gamma=0.5x^3-1.5x^2+2x$. This latter function is particularly desirable from a gate count standpoint, in that the coefficients 0.5, −1.5, and 2 can be implemented as simple binary shifts and additions, without need for more costly multiplication or division operations.

Varying any of these conditions will result in somewhat different gamma functions y, with differing coefficients A, B, C.

Panel gamma block 50 implements the substantial inverse of the gamma function of output gamma block 40. Thus, for $y=0.5x^3-1.5x^2+2x$, block 50 would implement the inverse function $0.5x^3+0.5x$. Here, the "inverse" may be the precise mathematical inverse of the function implemented by output gamma block 40, or may be any function that results in a substantially (though not necessarily exactly) linear luminance function, as shown by the graph of combined output gamma at the bottom of FIG. 4.

The panel gamma block 50 can follow a conventional digital/analog design, with digital input values producing output analog levels that in turn control the luminance of each subpixel or display element. However, the circuit design is roughly optimized not for a 2.2 gamma characteristic, but rather for a characteristic that is the "inverse" of the output gamma cubic polynomial function. The detailed characteristics of this functional block can be defined by register parameters, in known fashion. These parameters can be tuned by input of the appropriate values in the registers, in such a way as to achieve a more precise "inverse" of the output gamma cubic polynomial function (or any other function, as desired).

One of skill will observe that the configuration of FIG. 4 is advantageous in that it yields largely the same benefits as the system of FIG. 3, yet does so without implementing a high-gate-count $\gamma=1/2.2$ block. Instead, a lower gate count polynomial block is implemented. Thus, systems of the invention allow for digital processing of gamma-corrected signals without the added cost resulting from implementation of high-gate-count power law functions.

Figure 5:
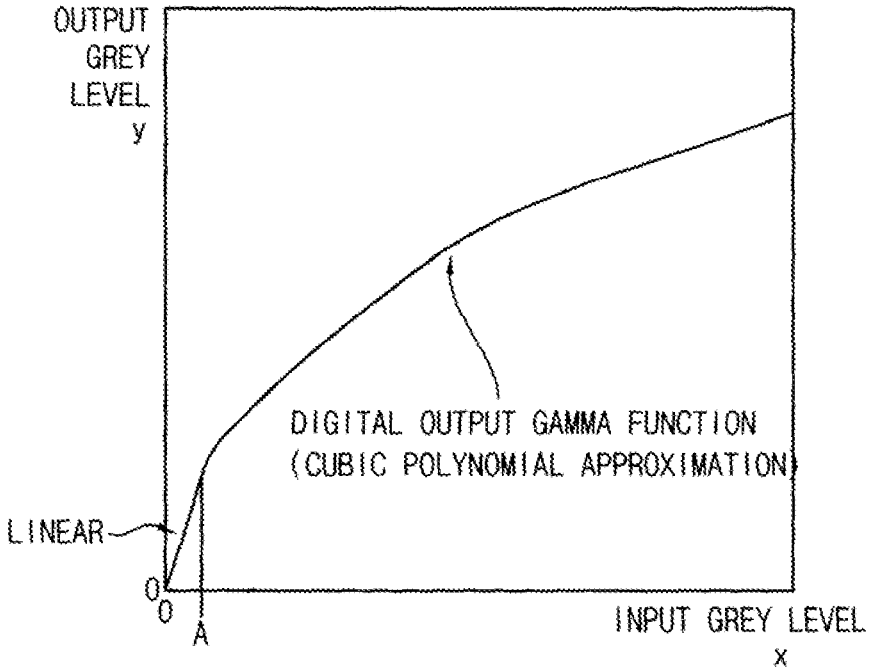
FIG. 5 is a graph conceptually illustrating an exemplary third order polynomial output gamma function of a further embodiment of the invention, in which the gamma function also includes a linear portion similar to an sRGB standard gamma function.

The cubic polynomial output gamma function may be a cubic function over its entire range of input values, or may be of differing order in certain ranges. For example, as with the standard sRGB gamma function, the cubic polynomial of embodiments of the invention may include a linear portion near its origin. For instance, with reference to FIG. 5, some third order polynomials according to the invention may be linear from the origin to point A, and cubic beyond A. The invention contemplates any value of A. The invention also contemplates any alternative values for the linear and cubic portions of the output gamma function, as well as any values of point A. For example, in one implementation of this inverse cubic function, low grey levels were mapped to output luminance levels that did not strictly follow the "inverse" guideline. Rather, they were tuned to appropriate lower levels that generated smooth results when displaying dark gradient test patterns. Such mapping is particularly desirable when reducing or compensating for excessively high digital values that may sometimes originate from a straight-line linear (non-cubic) portion at the low-end of the input gamma characteristic.

Figure 6:
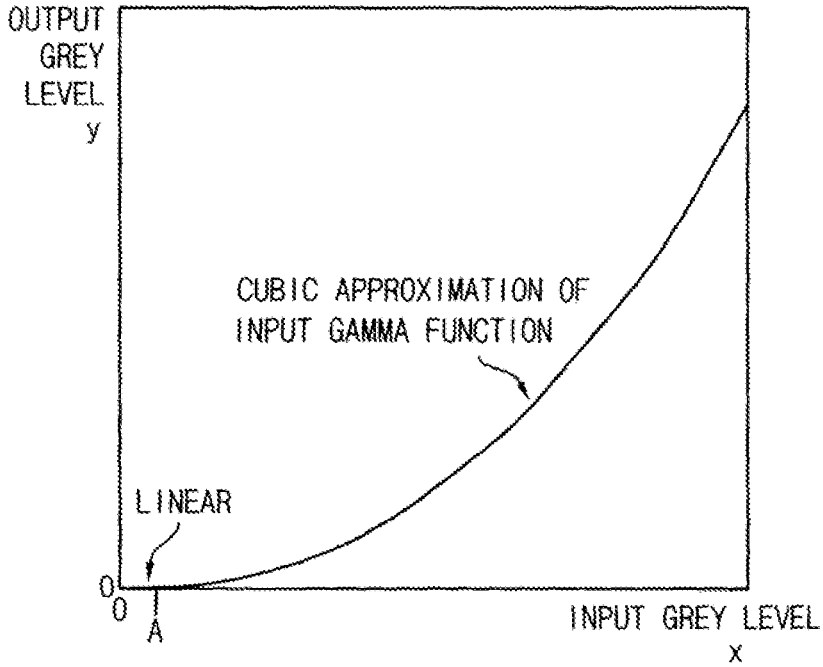
FIG. 6 is a graph conceptually illustrating an exemplary third order polynomial input gamma function of a further embodiment of the invention, in which the gamma function also includes a linear portion similar to an sRGB standard gamma function.

The invention also contemplates using a similar cubic polynomial to approximate the 2.2 power-law gamma function of input gamma block 20. In this case, the digital input gamma block can be relatively easily implemented in a form similar to equation (2), where y is the normalized digital output value of the input gamma block, x is the input value to that block, and exemplary values of the coefficients are A=0.25, B=0.75, C=0. Any other values for A, B, and C can also be used, but these values are often desirable in that they can be implemented with relatively simple shift and add operations, rather than full multiplications. As with the output gamma function approximations, the invention contemplates any form for the input gamma function approximation. For example, as shown in FIG. 6, the invention contemplates an input gamma function that has an initial linear portion, followed by a cubic approximation of a power-law gamma function. That is, the input gamma function approximation can take on any of the forms for the output and/or panel gamma functions described above.

The foregoing description, for purposes of explanation, used specific nomenclature to provide a thorough understanding of the invention. However, it will be apparent to one skilled in the art that the specific details are not required in order to practice the invention. Thus, the foregoing descriptions of specific embodiments of the present invention are presented for purposes of illustration and description. They are not intended to be exhaustive or to limit the invention to the precise forms disclosed. Many modifications and variations are possible in view of the above teachings. For example, the invention contemplates any gamma functions, and their inverses, that can be implemented with lower gate count than a typical power law gamma function. This can include gamma functions implemented as cubic functions or functions of any other polynomial order, as well as functions that include portions of lower order, such as linear portions, quadratic portions, or the like. Such polynomial functions can have coefficients of any suitable value. These gamma functions can be implemented as input gamma functions or as output and/or panel gamma functions. The embodiments were chosen and described in order to best explain the principles of the invention and its practical applications, to thereby enable others skilled in the art to best utilize the invention and various embodiments with various modifications as are suited to the particular use contemplated.

What is claimed is:

1. A display system, comprising:

a gamma preconditioning circuit configured to receive image data, to apply a first gamma function to the image data so as to generate gamma-compensated image data, and to output the gamma-compensated image data;

a processing circuit in electronic communication with the gamma preconditioning circuit, the processing circuit configured to receive the gamma-compensated image data, to perform an image processing operation on the gamma-compensated image data so as to generate processed image data, and to output the processed image data;

an output gamma circuit in electronic communication with the processing circuit, the output gamma circuit configured to receive the processed image data, to apply a second gamma function to the processed image data so as to generate gamma-encoded processed image data, and to output the gamma-encoded processed image data, wherein the second gamma function comprises a third order polynomial function given by $0.5x^3-1.5x^2+2x$ where x is a grey level of the processed image data; and a panel gamma circuit in electronic communication with the output gamma circuit, the panel gamma circuit configured to receive the gamma-encoded processed image data, and to apply a third gamma function to the gamma-encoded processed image data so as to generate gamma-decoded processed image data, wherein the third gamma function comprises substantially an inverse of the third order polynomial function.

2. The display system of claim 1, wherein the gamma preconditioning circuit outputs the gamma-compensated image data at a first bit depth, and the output gamma circuit outputs the gamma-encoded processed image data at a second bit depth that is less than the first bit depth.

3. The display system of claim 2, wherein the first bit depth is 11 bits.

4. The display system of claim 3, wherein the second bit depth comprises 8 bits and 2 dither bits.

5. The display system of claim 1, wherein the gamma preconditioning circuit outputs the gamma-compensated image data at a first bit depth, the output gamma circuit outputs the gamma-encoded processed image data at a second bit depth that is less than the first bit depth, and the gamma-decoded processed image data is generated at a third bit depth that is less than the second bit depth.

6. The display system of claim 1, wherein the inverse of the third order polynomial function is $0.5x^3+0.5x$ where x is the grey level of the gamma-encoded processed image data.

7. The display system of claim 1, wherein the third bit depth is 8 bits.

8. The display system of claim 1, wherein the second gamma function is a digital function, and the third gamma function is an analog function.

9. The display system of claim 1, wherein the second gamma function and the third gamma function each further comprise a first order polynomial function.

10. The display system of claim 1, wherein the first gamma function is a power-law function having $\gamma \approx 2.2$.

11. The display system of claim 1, wherein the first gamma function comprises a third order polynomial function.

12. A method of gamma-correcting image data, comprising:

applying a first gamma function to image data, so as to generate first compensated image data;

applying a second gamma function to the first compensated image data, so as to generate second compensated image data, wherein the second gamma function comprises a third order polynomial function given by $0.5x^3-1.5x^2+2x$ where x is a grey level of the first compensated image data; and applying a third gamma function to the second compensated image data so as to generate third compensated image data, wherein the third gamma function is substantially an inverse of the third order polynomial function.

13. The method of claim 12, wherein the inverse of the third order polynomial function is $0.5x^3+0.5x$ where x is a grey level of the second compensated image data.

14. The method of claim 12, further comprising increasing a bit depth of the image data, so as to generate the first compensated image data having a bit depth of 11 bits.

15. The method of claim 12, wherein the third compensated image data has a bit depth of 8 bits.

16. The method of claim 12, wherein the second gamma function is a digital function, and the third gamma function is an analog function.

17. The method of claim 12, wherein the second gamma function and the third gamma function each further comprise a first order polynomial function.

18. The method of claim 12, wherein the first gamma function comprises a third order polynomial function.

19. A non-transitory computer-readable medium, comprising: one or more non-transitory computer-readable mediums collectively storing instructions for carrying out a method, the method comprising:

applying a first gamma function to image data, so as to generate first compensated image data;

applying a second gamma function to the first compensated image data, so as to generate second compensated image data, wherein the second gamma function comprises a third order polynomial function given by $0.5x^3-1.5x^2+2x$ where x is a grey level of the first compensated image data; and applying a third gamma function to the second compensated image data so as to generate third compensated image data, wherein the third gamma function is substantially an inverse of the third order polynomial function.

20. The non-transitory computer-readable medium of claim 19, wherein the inverse of the third order polynomial function is $0.5x^3+0.5x$ where x is the grey level of the second compensated image data.

21. The non-transitory computer-readable medium of claim 19, wherein the second gamma function is a digital function, and the third gamma function is an analog function.

22. The non-transitory computer-readable medium of claim 19, wherein the second gamma function and the third gamma function each further comprise a first order polynomial function.

23. The non-transitory computer-readable medium of claim 19, wherein the first gamma function comprises a third order polynomial function.

* * * * *